US006080008A

United States Patent [19]

Frantz

[11] Patent Number: 6,080,008

[45] Date of Patent: Jun. 27, 2000

[54] PUSH-WIRE CONTACT

[75] Inventor: Robert Houston Frantz, Newville, Pa.

[73] Assignee: The Whitaker Corporation, Wilmington, Del.

[21] Appl. No.: 09/085,786

[22] Filed: May 28, 1998

[51] Int. Cl.[7] ..... H01R 4/24

[52] U.S. Cl. ..... 439/441

[58] Field of Search ..... 439/439, 440, 439/441, 922, 438

[56] References Cited

U.S. PATENT DOCUMENTS

| | | | |
|---|---|---|---|
| 3,704,438 | 11/1972 | Boone | 439/439 |
| 3,867,004 | 2/1975 | Komorowski et al. | 339/95 D |
| 4,576,429 | 3/1986 | Hardouin et al. | 339/95 D |
| 4,673,232 | 6/1987 | Kubota et al. | 439/441 |
| 4,722,579 | 2/1988 | Cummings et al. | 439/441 |
| 4,795,179 | 1/1989 | Lin | 439/441 |
| 4,971,567 | 11/1990 | Mizuno et al. | 439/441 |
| 5,015,201 | 5/1991 | Brezee et al. | 439/441 |
| 5,174,784 | 12/1992 | Penning | 439/441 |
| 5,292,260 | 3/1994 | Sinisi et al. | 439/441 |
| 5,324,213 | 6/1994 | Frantz | 439/441 |
| 5,445,528 | 8/1995 | Frantz | 439/79 |
| 5,729,442 | 3/1998 | Frantz | 361/823 |
| 5,895,286 | 4/1999 | Linke | 439/441 |
| 6,012,944 | 1/2000 | Hatakeyama | 439/441 |

FOREIGN PATENT DOCUMENTS

| | | | |
|---|---|---|---|
| 659918 | 2/1987 | Sweden | 439/441 |

*Primary Examiner*—Hien Vu
*Assistant Examiner*—Tho Dac Ta

[57] ABSTRACT

The present invention is directed to a push-wire electrical contact. The contact comprises a body, a plurality of arms coupled to said body, said arms having free ends. The arms being positioned such that the free ends of the arms are adapted to receive an electrical wire therebetween, and are spaced apart a distance that is slightly less than the diameter of the wire. The contact may be used with or without a housing that can be positioned over the body and the arms of the contact.

18 Claims, 3 Drawing Sheets

SECTION X–X

SECTION Z–Z

SECTION X–X

SECTION Z–Z

PUSH-WIRE CONTACT

BACKGROUND OF THE INVENTION

1. Field of the Invention

The present invention is related to electrical connectors, and, more particularly, to a push-wire contact.

2. Description of the Related Art

It is generally desirable to have a quick, effective means for connecting wires to a variety of electrical devices, including, but not limited to, fluorescent electrical ballasts. Such devices are typically connected to an electrical wire or conductor by securing the bare end of the electrical wire to an appropriate terminal or bus by a screw and/or by a push-wire contact.

The use of push-wire contacts to connect electrical wires to various devices is typically easier and more efficient than making such connections with screw-type methods. Typically, a push-wire contact is electrically coupled or mounted to a device, and, after the insulation is stripped from the electrical wire, the wire is electrically coupled to the device by inserting the bare wire into the contact.

Given the relative ease of use of push-wire connections, as compared to screw-type connections, it is highly desirable to have a push-wire contact that is dependable, efficient and adaptable to a variety of applications and devices.

The present invention is directed to an electrical contact that solves or reduces some or all of the aforementioned problems.

SUMMARY OF THE INVENTION

The present invention is directed to an electrical contact. The contact is comprised of a body having first and second connecting portions, one of the portions being a plurality of arms coupled to the body, each of the arms having a free end. The arms are properly positioned such that the free ends of the arms are adjacent one another and adapted to receive a wire inserted therebetween.

BRIEF DESCRIPTION OF THE DRAWINGS

The invention may be understood by reference to the following description taken in conjunction with the accompanying drawings, in which like reference numerals identify like elements, and in which.

Figure 2:
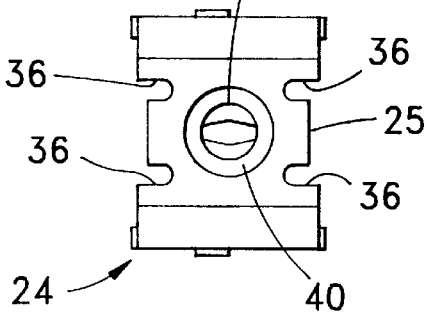
FIG. 2 is a top view of the device shown in FIG. 1.
Figure 1:
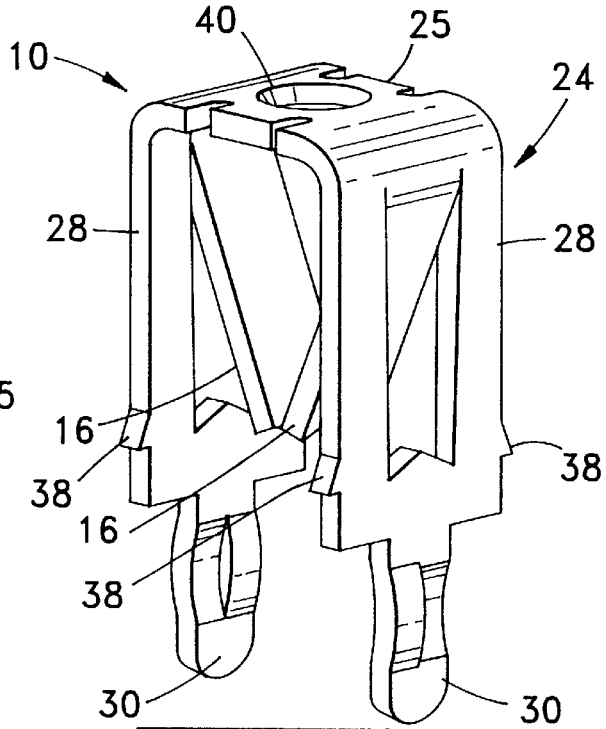
FIG. 1 is a perspective view of one illustrative embodiment of the electrical contact of the present invention.
Figure 3:
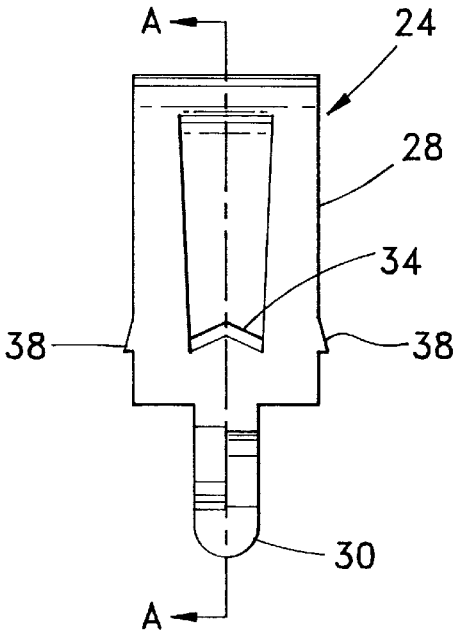
FIG. 3 is a side view of the device shown in FIG. 1.
Figure 4:
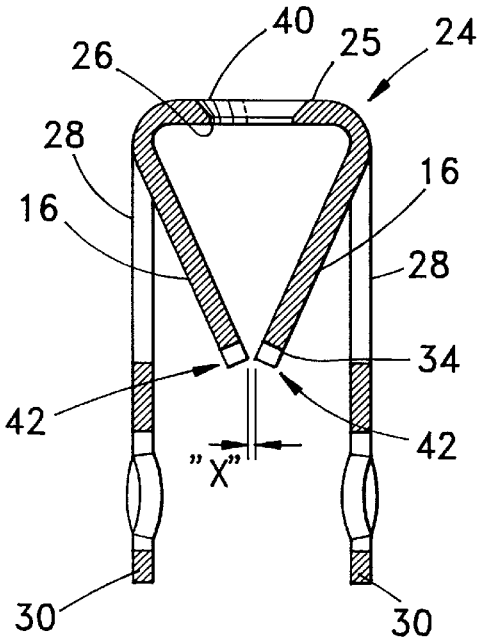
FIG. 4 is a cross-sectional view of the device shown in FIG. 1.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

As shown in FIGS. 1–4, a push-wire contact 10 of the present invention may be comprised of a generally rectangular prismatic or block-like body 24 having an upper flange or wall 25 with an opening or wire receiving aperture 26 formed therein, a plurality of side members 28, a plurality of connection tabs or legs defining a first connecting portion 30, and a plurality of inwardly extending arms 16 defining a second connecting portion. The inwardly extending arms 16 have free ends 42 formed thereon. In one illustrative embodiment, the free ends 42 of the arms 16 may have an angular end 34 formed thereon. The contact 10 may further comprise a plurality of recesses 36 formed in the upper flange 25, and a plurality of barbs 38 formed on the side members 28. In one embodiment, the opening 26 may have a countersink profile 40.

The arms 16 are fabricated such that, when completed, the free ends 42 of the arms 16 are spaced apart a specific dimension. In one embodiment of the present invention having angular ends 34 formed on the free ends 42 of the arms 16, this dimension is shown as "X" in FIG. 4. The dimension "X" will vary with the application requirements for use of the contact 10 (as will be discussed more fully below).

As shown in FIGS. 1–4, in one illustrative embodiment, the arms 16 may be formed integrally with the body 24 or may be a separate component that is attached to the body 24. It is simply desirable for the arms 16 to be substantially coupled to the body 24 in some manner. The recesses 36 may be used during manufacturing operations to position or locate the contact 10 as it proceeds through the manufacturing process.

Figure 5:
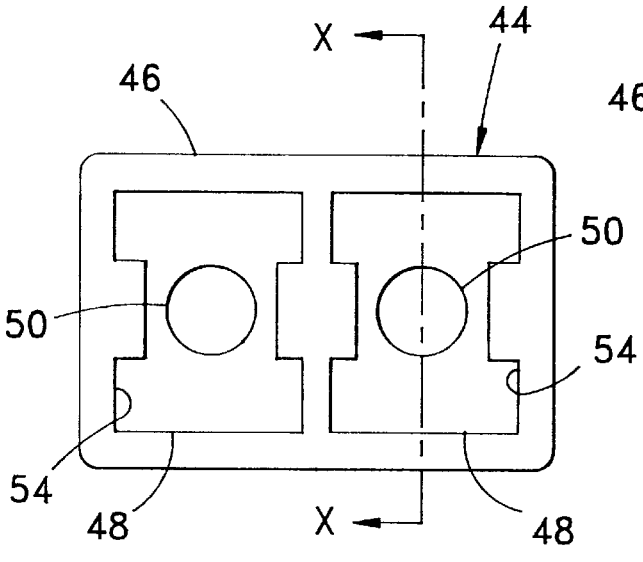
FIG. 5 is a bottom view of an illustrative housing that may be used with one embodiment of the present invention.
Figure 6:
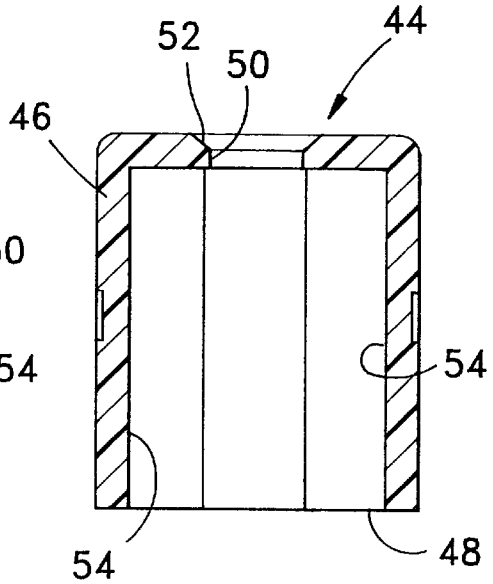
FIG. 6 is a cross-sectional view of an illustrative housing that may be used with one embodiment of the present invention.

A housing 44 for the illustrative embodiment of the contact 10 in FIGS. 1–4 is shown in FIGS. 5 and 6. The housing 44 is generally comprised of a body 46 having two cavities 48 formed therein, and an opening 50 in each of the cavities 48. In one embodiment, the openings 50 may have a countersink profile 52. It should be noted that the contact 10 of the present invention may be used with or without a housing 44, depending upon the particular application and environment in which the contact 10 will be used.

The cavities 48 in the housing 44 are adapted to receive the illustrative embodiment of the contact 10 as shown in FIGS. 1–4. The cavities 48 are sized such that the barbs 38 on the side members 28 of the contact 10 engage an inner surface 54 of the cavities 48 and thereby retain the contact 10 in the housing 44. As is readily apparent, the openings 50 in the housing 44 are aligned with the openings 26 in the contact 10. Although the housing 44, as shown in FIGS. 5 and 6, is designed to accept two of the contacts 10 shown in FIGS. 1–4, those skilled in the art recognize that the housing 44 may be readily adapted to accommodate a single contact or more than two contacts depending upon the particular application under consideration.

FIGS. 7–10 depict yet another illustrative embodiment of the present invention. The contact 110 may be comprised of a generally cylindrical body 124 having an opening 126, a plurality of barbs 138, a plurality of inwardly extending arms 116, and a plurality of connection tabs 130. The inwardly extending arms 116 have free ends 142 formed thereon. In one illustrative embodiment, the free ends 142 of the arms 116 may have a curved end 135 formed thereon.

The arms 116 are fabricated such that, when completed, the free ends 142 of the arms 116 are spaced apart a specific amount. In one embodiment of the present invention having curved ends 135 formed on the free ends 142 of the arms 116, the spacing may be defined by the spacing at the center of the curved ends 135 (indicated as dimension "Y" in FIG. 8) and the spacing at the ends 137 of the curved ends 135 (indicated as dimension "Z" in FIG. 9). The value of the dimensions "Y" and "Z" will vary with the application requirements for use of the contact 110 (as will be discussed more fully below).

Figure 11:
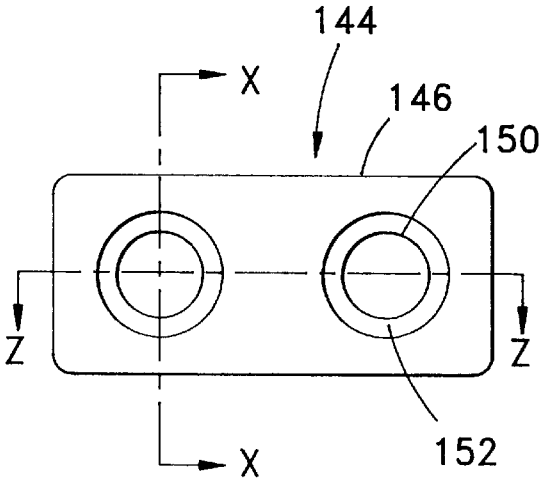
FIG. 11 is a top view of an illustrative housing that may be used with one embodiment of the present invention.
Figure 12:
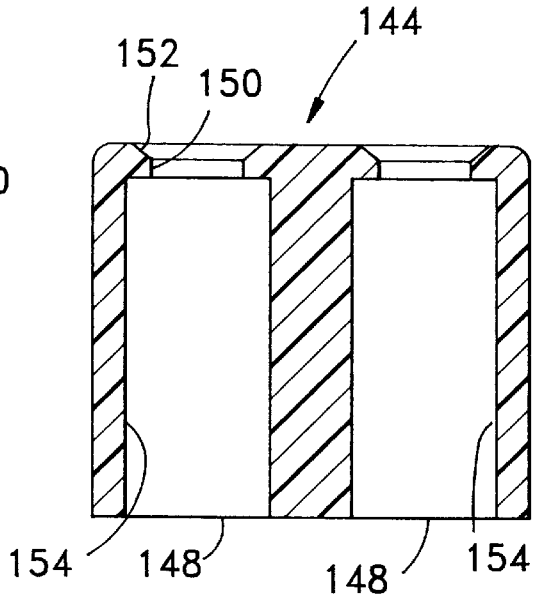
FIG. 12 is a cross-sectional view of an illustrative housing that may be used with one embodiment of the present invention.
Figure 8:
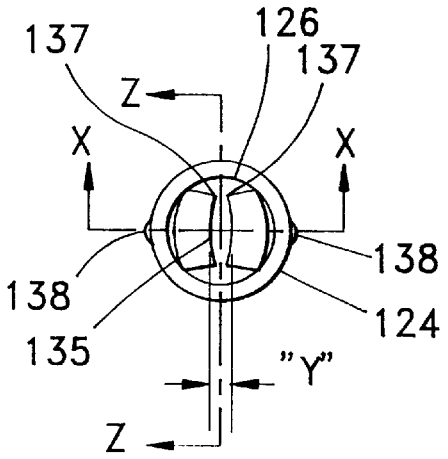
FIG. 8 is a top view of the device shown in FIG. 7.
Figure 7:
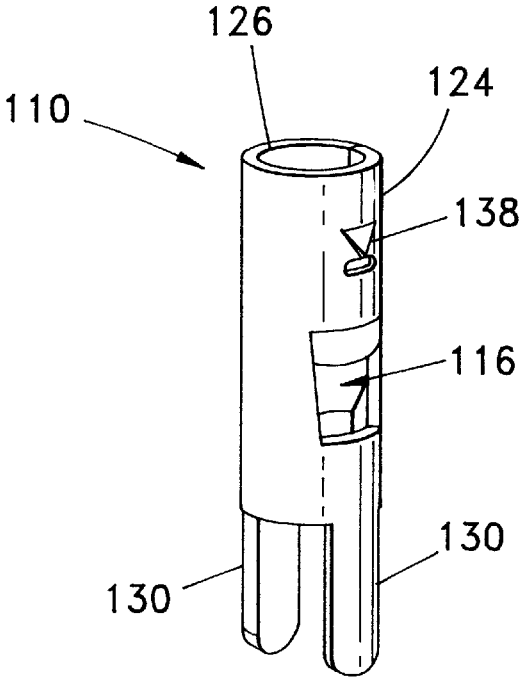
FIG. 7 is a perspective view of yet another illustrative embodiment of the present invention.
Figure 9:
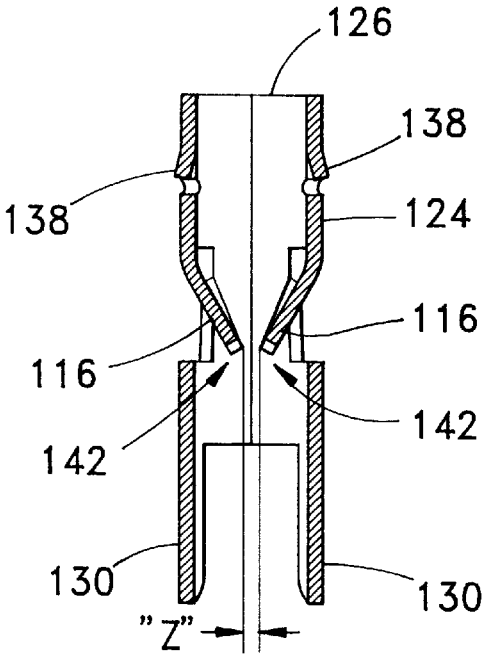
FIG. 9 is a cross-sectional view of the device shown in FIG. 7.
Figure 10:
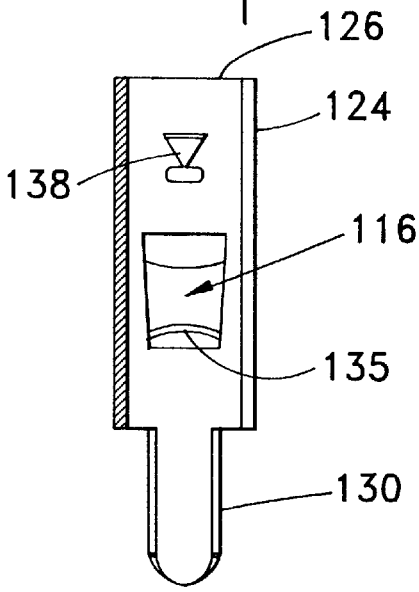
FIG. 10 is a partial cross-sectional side view of the device shown in FIG. 7.

A housing 144 for the illustrative embodiment of the contact 110 shown in FIGS. 7–10 is shown in FIGS. 11 and 12. The housing 144 is generally comprised of a body 146 having two cavities 148 formed therein, and an opening 150 formed in each of the cavities 148. In one embodiment, the opening 150 may have a countersink profile 152.

The cavities 148 in the housing 144 are adapted to receive the illustrative embodiment of the contact 110 shown in FIGS. 7–10. The cavities 148 are sized such that the barbs 138 on the body 124 of the contact 10 engage an inner surface 154 of the cavities 148, and thereby retain the contact 110 in the housing 144. As is readily apparent, the openings 150 in the housing 144 are aligned with the opening 126 in the contact 110. Although the housing 144, as shown in FIGS. 11 and 12, is designed to accept two of the illustrative contacts 110 depicted in FIGS. 7–10, those skilled in the art recognize that the housing 144 may be readily adapted to accommodate a single contact 110 or more than two contacts 110, depending upon the particular application under consideration.

The present invention may be used in a variety of applications. However, by way of illustration only, the use of the present invention in one illustrative application will now be described.

The contact 10, 110 may be used to electrically connect a solid electric wire, such as, for example, a power supply wire, to, for example, a printed circuit board on a fluorescent light ballast. The connection tabs 30, 130, as shown in the drawings, are adapted for through-hole connection to a printed circuit board (not shown) by, for example, soldering. As is apparent to those skilled in the art, the tabs 30, 130 could be designed as surface mount connections, which could then be attached to the printed circuit board (not shown) by soldering. Additionally, the tabs 30, 130 are not absolutely required in that the contact 10, 110 could be modified to eliminate the tabs 30, 130 altogether and attach the body 24, 124 directly to the device under consideration.

However, the present invention is not limited to the particular configuration of the connection tabs 30, 130 shown in the drawings. To the contrary, all that is required is that the free ends 42, 142 of the arms 16, 116 be electrically coupled to the device under consideration. This objective can be accomplished by a variety of techniques readily known to those skilled in the art. For example, the arms 16, 116 could have an extension formed thereon that would be electrically coupled to the device under consideration.

As stated previously, the arms 16, 116 are fabricated such that the free ends 42, 142 of the arms, respectively, are adjacent one another and spaced apart specific amounts. The spaced-apart free ends 42, 142 are adapted to receive a wire therebetween. The amount of the spacing between the free ends 42, 142 is indicated by the dimensions "X," "Y" and "Z" shown in FIGS. 4, 8 and 9 for the various illustrative embodiments of the contacts 10, 110 discussed above. The values of these various dimensions, "X," "Y" and "Z," is determined by the size of the solid wire conductor (not shown) that will be inserted into the contact 10, 110.

For example, the dimension "X" is approximately 0.2 mm for an illustrative contact 10 (shown in FIGS. 1–4) having angular ends 34 formed on the free ends 42 of the arms 16 that is to be electrically coupled to a 18 AWG solid wire conductor. As is readily apparent, if larger wire is used, the dimension "X" may increase; if smaller wire is used, the dimension "X" may decrease.

Similarly, the dimensions "Y" and "Z" will be approximately 0.5 mm and 0.25 mm, respectively, for an illustrative contact 110 (shown in FIGS. 7–10) having curved ends 135 formed in the free ends 142 of the arms 116 that is to be electrically coupled to an 18 AWG solid wire conductor. As is readily apparent, if larger wire is used, the dimensions "Y" (spacing between the centers of the curved ends 135) and/or "Z" (spacing between the ends 137 of the curved ends 135) may increase, and, if smaller wire is used, these dimensions may decrease.

All that is required is that the free ends 42, 142 of the arms 16, 116 be sized such that, when the solid wire conductor is inserted between the free ends 42, 142, it will force the arms 16, 116 outwardly, thereby biasing the arms 16, 116 to move in an inward direction, which forces the free ends 42, 142 to stay engaged with the wire. That is, the free ends 42, 142 of the arms 16, 116 are spaced apart by a distance that is less than the diameter of the wire to be inserted therebetween.

The free ends 42, 142 of the arms 16, 116 may have angular ends 34 (see FIG. 3), curved ends 135 (see FIG. 10) or a straight end (not shown) formed thereon. Of course, the free ends 42, 142 may have ends that are formed in any desired shape. If a straight end is used, it results in a two-point contact with the inserted wire. If an angular end 34 is formed on the ends 42, 142 of the arms 16, 116, the wire is engaged at four points, thereby providing a more secure connection and some redundancy to the electrical connection. If a curved end 135 is formed on the ends 42, 142 of the arms 16, 116, the wire is engaged along an extended line.

Although the present contact 10, 110 is not designed to be releasable, i.e., once the wire is inserted, it cannot be removed, it is apparent that, with slight modifications, the contact 10, 110 could be made to be releasable. For example, an additional opening could be formed in the contact body and/or housing to accommodate a tool, such as a screwdriver, that could be inserted through the additional opening to engage the arms 16, 116 of the contact 10, 110 and force them apart, thereby releasing any engaged wire.

In practice, the connection tabs 30, 130 of the contact 10, 110 of the present invention are inserted through holes in a printed circuit board (not shown) and soldered to the printed circuit board. If desired or necessary, a housing 44, 144 may next be placed on the contact 10, 110 and may be secured thereto by engagement with the barbs 38, 138 formed on the contact 10, 110. As stated previously, the use of a housing 44, 144 is not required with the present invention. Thereafter, a solid wire conductor may be inserted into the opening(s) formed in the contacts 10, 110 and/or housing 44, 144 until such time as the wire engages the free ends 42, 142 of the contact 10, 110.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. An electrical contact comprising:

an elongate body having first and second connecting portions;

said first connecting portion including an upper wall connecting at least two side members, each side member terminating in a connection leg the at least two side members spaced from one another and the legs adapted to be mounted to an electrical article and terminated thereto;

said second connecting portion including at least two arms, one of the at least two arms extending from each of the at least two side members along a longitudinal section of said body toward said connection legs, said arms extending to free ends between said at least two side members with said free ends being directed toward and spaced a selected distance from one another, said free ends being adapted to electrically engage a wire inserted therebetween;

said upper wall including a wire receiving aperture extending therethrough and in communication with said free ends of said arms, such that said wire inserted into said aperture can be received between said free ends and electrically connected thereto.

2. The electrical contact of claim 1 wherein said free ends of said arms have an angular surface.

3. The electrical contact of claim 1 wherein said free ends of said arms have a curved surface.

4. The electrical contact of claim 1 wherein said free ends of said arms have a straight surface.

5. An electrical connector comprising a housing having at least one electrical contact in accordance with claim 1 disposed in a contact receiving cavity thereof.

6. The electrical connector of claim 5 wherein said contact includes at least one retention barb for engaging a surface of said cavity.

7. An electrical contact comprising:

an elongate body having first and second connecting portions;

said body being a rectangular prismatic member having an upper wall and at least two side members spaced from one another and downwardly from edges of said upper wall to leading ends;

said leading end of each of said first and second side members including a connection leg, the at least first and second legs defining said first connecting portion, said connection legs being adapted to be mounted to an electrical article and terminated thereto;

each of said first and second side members further including an arm extending along a section thereof toward said connection legs, each arm extending to a free end with said free end of said arm of said first side member being directed toward and spaced a selected distance from the free end of said arm of said second side member, the at least first and second arms defining said first connecting portion, said free ends being adapted to electrically engage a wire inserted therebetween;

said base of said body including a wire receiving aperture extending therethrough and in communication with said free ends of said arms, such that the said wire inserted into said aperture can be received between said free ends and electrically connected thereto.

8. The electrical contact of claim 7 wherein said free ends of said arms have an angular surface.

9. The electrical contact of claim 7 wherein said free ends of said arms have a curved surface.

10. The electrical contact of claim 7 wherein said free ends of said arms have a straight surface.

11. An electrical connector comprising a housing having at least one electrical contact in accordance with claim 7 disposed in a contact receiving cavity thereof.

12. The electrical connector of claim 11 wherein said contact includes at least one retention barb for engaging a surface of said cavity.

13. An electrical contact comprising:

an elongate body having first and second connecting portions;

said body being a cylindrical member;

said first connecting portion including at least two connection legs spaced from one another and the legs extending from one end of said cylindrical member, said connection legs being adapted to be mounted to an electrical article and terminated thereto;

said second connecting portion including at least two arms spaced from one another and extending from and along sides of said cylindrical member to toward said legs, said arms extending to free ends between said at least two connecting legs, said free ends of said at least two arms being directed toward and spaced a selected distance from one another, said free ends being adapted to electrically engage a wire inserted therebetween;

said cylindrical member including a wire receiving aperture extending therethrough and in communication with said free ends of said arms, such that said wire inserted into said aperture can be received between said free ends and electrically connected thereto.

14. The electrical contact of claim 13 wherein said free ends of said arms have an angular surface.

15. The electrical contact of claim 13 wherein said free ends of said arms have a curved surface.

16. The electrical contact of claim 13 wherein said free ends of said arms have a straight surface.

17. An electrical connector comprising a housing having at least one electrical contact in accordance with claim 13 disposed in a contact receiving cavity thereof.

18. The electrical connector of claim 17 wherein said contact includes at least one retention barb for engaging a surface of said cavity.

* * * * *